US012134165B2

(12) United States Patent
Fujimura

(10) Patent No.: US 12,134,165 B2
(45) Date of Patent: Nov. 5, 2024

(54) GRINDING METHOD OF WORKPIECE

(71) Applicant: DISCO CORPORATION, Tokyo (JP)

(72) Inventor: Satoru Fujimura, Tokyo (JP)

(73) Assignee: DISCO CORPORATION, Tokyo (JP)

( * ) Notice: Subject to any disclaimer, the term of this patent is extended or adjusted under 35 U.S.C. 154(b) by 342 days.

(21) Appl. No.: 17/455,492

(22) Filed: Nov. 18, 2021

(65) Prior Publication Data

US 2022/0184774 A1 Jun. 16, 2022

(30) Foreign Application Priority Data

Dec. 11, 2020 (JP) ..... 2020-205662

(51) Int. Cl.
*B24B 51/00* (2006.01)
*B24B 7/07* (2006.01)
*B24B 49/04* (2006.01)

(52) U.S. Cl.
CPC ..... *B24B 51/00* (2013.01); *B24B 49/04* (2013.01); *B24B 7/075* (2013.01)

(58) Field of Classification Search
CPC ..... B24B 51/00; B24B 7/04; B24B 7/228; B24B 7/075; B24B 7/241; B24B 41/002; B24B 41/047; B24B 41/061; B24B 41/067; B24B 41/068; B24B 49/04; B24B 49/12
See application file for complete search history.

(56) References Cited

U.S. PATENT DOCUMENTS 8,025,556 B2 * 9/2011 Kajiyama ..... B24B 27/0076 451/41
11,400,563 B2 * 8/2022 Inoue ..... B24B 37/30
2017/0095902 A1 * 4/2017 Yoshida ..... B24B 7/228

FOREIGN PATENT DOCUMENTS

JP 2009176848 A 8/2009
JP 2016016462 A 2/2016
JP 2016111143 A 6/2016

OTHER PUBLICATIONS

Japanese Patent Application No. JP 2020205662 A: English translation of Office Action, Jul. 30, 2024 (3 pages).

* cited by examiner

*Primary Examiner* — Eric J Rosen
*Assistant Examiner* — John C Merino
(74) *Attorney, Agent, or Firm* — Greer, Burns & Crain, Ltd.

(57) ABSTRACT

A grinding method for grinding a workpiece includes a first grinding step of grinding the workpiece in such a manner that an outer circumferential part of the workpiece becomes thinner than a central part of the workpiece, a measurement step of measuring the thickness of the workpiece at the outer circumferential part, and a second grinding step of grinding the workpiece. In the second grinding step, the grinding is started from the central part of the workpiece and the grinding is ended when the workpiece reaches a finished thickness decided based on the thickness of the workpiece at the outer circumferential part measured in the measurement step.

11 Claims, 5 Drawing Sheets

GRINDING METHOD OF WORKPIECE

BACKGROUND OF THE INVENTION

Field of the Invention

The present invention relates to a grinding method of a workpiece by which the workpiece formed of a hard material such as silicon carbide (SiC) is ground to be planarized.

Description of the Related Art

When device chips on which a power device that is capable of high-temperature operation and has a high breakdown voltage is mounted or device chips on which a device such as large scale integration (LSI) is mounted are manufactured, for example, an SiC wafer with a circular plate shape is used. When plural devices are made on a surface of the SiC wafer and the SiC wafer is divided for each device, the individual device chips are obtained. The SiC wafer with a circular plate shape is manufactured by a method of cutting an SiC ingot with a circular column shape. For example, the focal point of a laser beam with a wavelength that allows transmission through SiC is positioned to a depth equivalent to the thickness of the wafer to be manufactured, and the SiC ingot is irradiated with the laser beam. A modified layer that becomes the origin of separation is thereby formed inside the SiC ingot (refer to Japanese Patent Laid-open No. 2016-111143).

Damage that accompanies separation and the formation of the modified layer is left in the surface of the SiC wafer cut out from the SiC ingot. Thus, the surface of the SiC wafer is ground, and a layer in which the damage is caused is removed. The grinding of a workpiece such as the SiC wafer is executed by a grinding apparatus. In the grinding apparatus, the grinding of the workpiece is executed at plural stages. First, a first grinding step that is referred to as rough grinding and by which the workpiece is ground to a large extent at a comparatively high speed and the layer in which the damage is caused is removed is executed. A layer in which damage is caused due to the rough grinding is further formed in the grinding-target surface of the workpiece. Therefore, a second grinding step that is referred to as finish grinding and by which the workpiece is ground with high quality at a comparatively low speed and the layer in which the damage is caused is removed.

The grinding apparatus includes a holding table having an upper surface that serves as a holding surface that holds a workpiece and a first grinding unit and a second grinding unit disposed over the holding table. Each grinding unit includes a grinding wheel on which grinding abrasive stones arranged in a circular annular manner are mounted. Further, the grinding apparatus can rotate the holding table around a table rotation axis that passes through the center of the holding surface and can rotate the grinding abrasive stones on an annular track through rotating each grinding wheel. When the grinding unit is lowered and the grinding abrasive stones that rotate are brought into contact with a workpiece, the workpiece is ground. The lowering speed of the grinding unit in the finish grinding is comparatively low. Therefore, if a rise in the area of the contact of the grinding abrasive stones with the workpiece is too sharp at the moment when the grinding abrasive stones get contact with the grinding-target surface of the workpiece when the finish grinding is started after the rough grinding is executed, it becomes difficult for the grinding abrasive stones to bite into the workpiece. Thus, a conical surface that gently inclines from the central part of the workpiece to the outer circumferential part thereof is formed as the grinding-target surface of the workpiece when the rough grinding ends, and the central part of the workpiece is set thick compared with the outer circumferential part.

This can be implemented by employing a conical surface that gently inclines as the holding surface of the holding table and by tilting the holding table relative to the grinding wheel in such a manner that the generatrix closest to a rotation plane including the annular track of the grinding abrasive stones in the generatrices that configure the holding surface becomes non-parallel to the rotation plane. Thereafter, when the finish grinding is executed, the relative tilt between the holding table and the grinding wheel is adjusted in such a manner that the generatrix closest to the rotation plane in the holding surface becomes parallel to the rotation plane, and the grinding abrasive stones that move on the annular track are brought into contact with the workpiece in which the central part is thicker than the outer circumferential part. In this case, when the finish grinding is started, first, the grinding abrasive stones get contact with the relatively high central part in the workpiece. At this time, the area of the contact of the grinding abrasive stones with the workpiece is small. Therefore, the grinding abrasive stones easily bite into the workpiece. Then, the contact area gradually becomes larger as the finish grinding progresses and the height of the central part becomes smaller, and finally the grinding abrasive stones get contact with the whole of the grinding-target surface of the workpiece.

SUMMARY OF THE INVENTION

In the rough grinding of a hard workpiece such as an SiC wafer, the grinding load greatly varies when the state of the grinding abrasive stones slightly changes and therefore, variation in the grinding result is large. For example, the height difference between the central part and the outer circumferential part of the workpiece greatly varies. When this variation is large, the outer circumferential part of the workpiece is not sufficiently ground when the finish grinding of the workpiece is executed, in some cases. Thus, it is conceivable that the removal thickness of the workpiece in the finish grinding is set large. However, in this case, the amount of grinding may become unnecessarily large. When the amount of grinding becomes large, the processing time increases. Further, wear of the grinding abrasive stones becomes large, and frequent replacement work is required, for example. Thus, the large amount of grinding is a cause of lowering of the processing efficiency.

Thus, an object of the present invention is to provide a grinding method of a workpiece that can grind the workpiece highly efficiently and surely.

In accordance with an aspect of the present invention, there is provided a grinding method of a workpiece that is a grinding method for grinding the workpiece. The grinding method includes a holding step of placing the workpiece over a holding surface of a holding table that has the holding surface with a conical surface shape as an upper surface and that is rotatable around a table rotation axis that passes through the center of the holding surface and holding the workpiece by the holding table and a first grinding step of grinding the workpiece in such a manner that an outer circumferential part of the workpiece becomes thinner than a central part of the workpiece by rotating a first spindle having a lower end to which a first grinding wheel having first grinding abrasive stones on a bottom surface is fixed to rotate the first grinding abrasive stones on a first annular track and by bringing the holding table and the first grinding wheel close to each other to cause the first grinding abrasive stones to get contact with the workpiece in a state in which a generatrix closest to the first grinding abrasive stones in the holding surface with the conical surface shape is set non-parallel to the first annular track. The grinding method further includes a measurement step of measuring the thickness of the workpiece at the outer circumferential part or the height of an upper surface of the workpiece at the outer circumferential part after the first grinding step and a second grinding step of grinding the workpiece by rotating a second spindle having a lower end to which a second grinding wheel having second grinding abrasive stones on a bottom surface is fixed to rotate the second grinding abrasive stones on a second annular track and by bringing the holding table and the second grinding wheel close to each other to cause the second grinding abrasive stones to get contact with the workpiece in a state in which a generatrix closest to the second grinding abrasive stones in the holding surface with the conical surface shape is set parallel to the second annular track. In the second grinding step, the grinding is started from the central part of the workpiece and the grinding is ended when the workpiece reaches a finished thickness decided based on the thickness of the workpiece at the outer circumferential part or the height of the upper surface of the workpiece at the outer circumferential part, the thickness or the height being measured in the measurement step.

Preferably, the second grinding abrasive stones contain abrasive grains with a grain size smaller than the grain size of abrasive grains contained in the first grinding abrasive stones.

In the grinding method of a workpiece according to the aspect of the present invention, after the first grinding step is executed, the measurement step is executed to measure the thickness of the workpiece at the outer circumferential part or the like. Then, in the second grinding step, the grinding is ended when the workpiece reaches the finished thickness decided based on the measured thickness of the workpiece at the outer circumferential part, or the like. That is, the thickness of the workpiece when the grinding in the second grinding step is ended is decided based on a thickness of the outer circumferential part that has become thinner than the central part at the timing of the end of the first grinding step. Thus, at the outer circumferential part of the workpiece, at which a layer in which damage is caused progresses to the deepest position in the first grinding step, the workpiece can be ground with an amount of grinding necessary and sufficient to remove this layer.

Therefore, by the present invention, a grinding method of a workpiece that can grind the workpiece highly efficiently and surely is provided.

The above and other objects, features and advantages of the present invention and the manner of realizing them will become more apparent, and the invention itself will best be understood from a study of the following description and appended claims with reference to the attached drawings showing a preferred embodiment of the invention.

DETAILED DESCRIPTION OF THE PREFERRED EMBODIMENT

Figure 1:
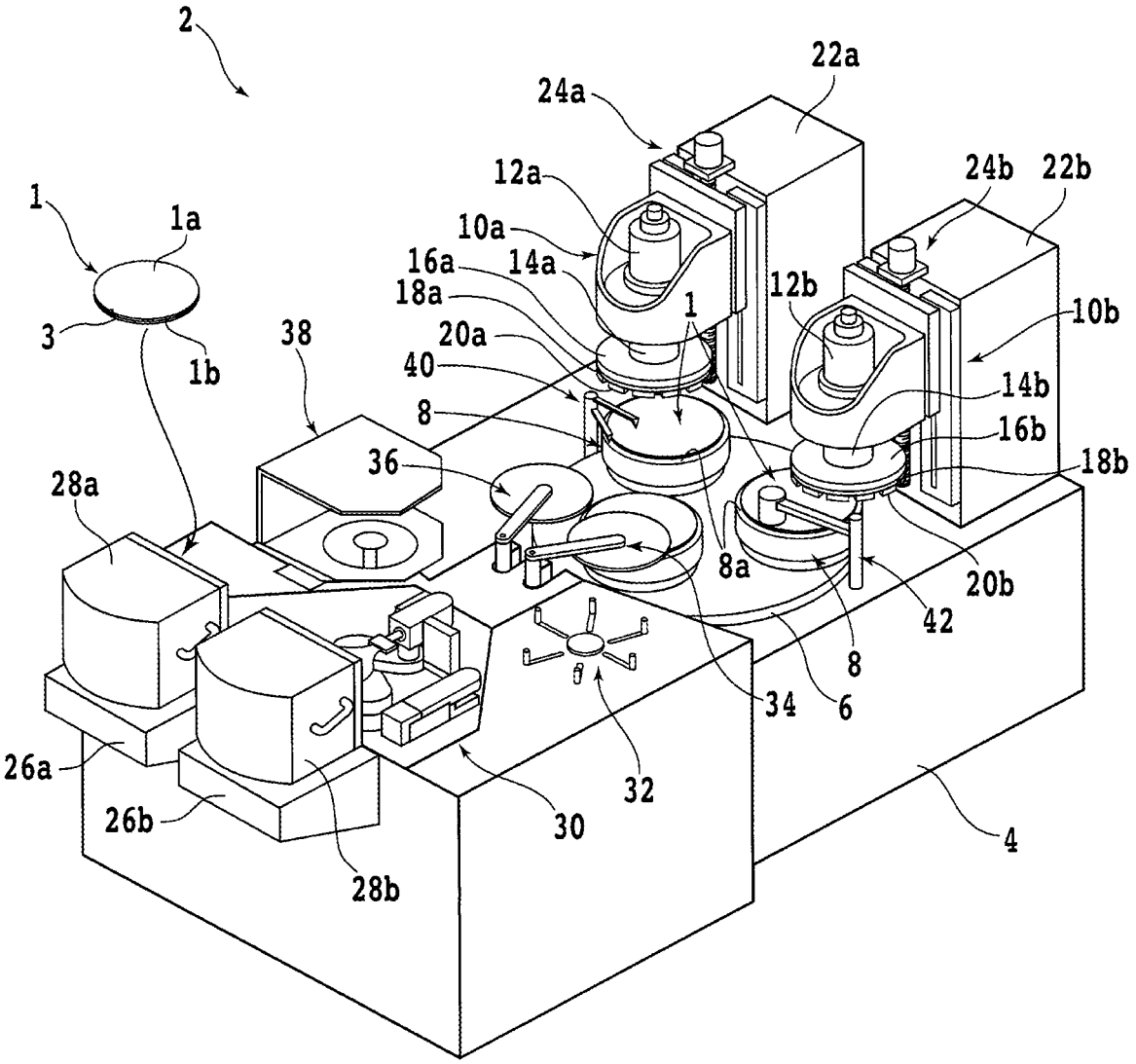
FIG. 1 is a perspective view schematically illustrating a grinding apparatus and a workpiece.

An embodiment according to the present invention will be described with reference to the drawings. In a grinding method of a workpiece according to the present embodiment, the workpiece is ground to be thinned by a grinding apparatus. First, the workpiece will be described. In FIG. 1, a perspective view schematically illustrating a workpiece 1 is included. For example, the workpiece 1 is a wafer or the like that has a substantially circular plate shape and that is composed of a material such as Si, SiC, gallium nitride (GaN), gallium arsenide (GaAs), or another semiconductor. In particular, in the processing method of a workpiece according to the present embodiment, the workpiece 1 such as a wafer formed of a hard material such as SiC or GaN can be favorably ground. However, the workpiece 1 is not limited thereto. The workpiece such as a wafer with a circular plate shape is formed by cutting an ingot with a circular column shape, for example. When the wafer with a circular plate shape is formed, plural devices are arranged on a surface of the wafer in a matrix manner, and the wafer is divided for each device, individual device chips are obtained.

In recent years, attention has been paid to an SiC wafer as a wafer used in manufacturing of device chips on which a power device that is capable of high-temperature operation and that has a high breakdown voltage is mounted or device chips on which a device such as LSI is mounted. The SiC wafer is formed by cutting an SiC ingot (for example, hexagonal single crystal ingot). When the SiC ingot is cut, for example, the SiC ingot is irradiated with a laser beam with such a wavelength as to be transmitted through SiC. At this time, the focal point of the laser beam is positioned to a predetermined depth position equivalent to the thickness of the SiC wafer to be manufactured, and the SiC ingot is irradiated with the laser beam while the focal point is relatively moved horizontally. A modified layer that becomes the origin of separation is thereby formed inside the SiC ingot. Then, when the SiC ingot is cut with use of the modified layer as the point of origin, the SiC wafer is obtained.

A layer in which damage is caused in the process of the cutting, a minute recess-projection shape, and so forth are left in the cut surface of the obtained SiC wafer. Therefore, grinding is executed for the SiC wafer. A grinding apparatus 2 is used for the grinding of the workpiece 1 such as the SiC wafer. The case in which an SiC wafer as the workpiece 1 is ground by the grinding apparatus 2 will be described below. However, the workpiece 1 in the grinding method of a workpiece according to the present embodiment is not limited thereto. A tape-shaped protective member 3 is stuck in advance to a back surface 1*b* on the side opposite to a grinding-target surface 1*a* of the workpiece 1 to be ground by the grinding apparatus 2.

Next, the grinding apparatus 2 with which the grinding method of the workpiece 1 according to the present embodiment is executed will be described in detail. The grinding apparatus 2 includes a base 4 that supports each constituent element. Cassette placement pedestals 26*a* and 26*b* are fixed to the front end of the base 4. For example, a cassette 28*a* in which the workpieces 1 before grinding are housed is placed on the cassette placement pedestal 26*a*, and a cassette 28*b* for housing the workpieces 1 for which grinding has ended is placed on the cassette placement pedestal 26*b*. A wafer conveying robot 30 is installed at a position adjacent to the cassette placement pedestals 26*a* and 26*b* on the base 4. The wafer conveying robot 30 carries out the workpiece 1 from the cassette 28*a* placed on the cassette placement pedestal 26*a* and conveys the workpiece 1 to a positioning table 32 disposed at a position adjacent to the wafer conveying robot 30 on the base 4. The positioning table 32 has plural positioning pins that are annularly arranged. When the workpiece 1 is placed on a placement region at the center, the positioning table 32 positions the workpiece 1 to a planned position by causing each of the positioning pins to move inward in the radial direction in conjunction with each other.

At positions adjacent to the positioning table 32 on the upper surface of the base 4, a loading arm 34 and an unloading arm 36 are disposed. The workpiece 1 positioned to the planned position by the positioning table 32 is conveyed by the loading arm 34. On the upper surface of the center of the base 4, a turntable 6 with a circular plate shape is disposed rotatably in a horizontal plane. Three holding tables 8 separate from each other by 120 degrees in the circular circumferential direction are set on the upper surface of the turntable 6. When the turntable 6 is rotated, each of the holding tables 8 can be moved.

Figure 2A:
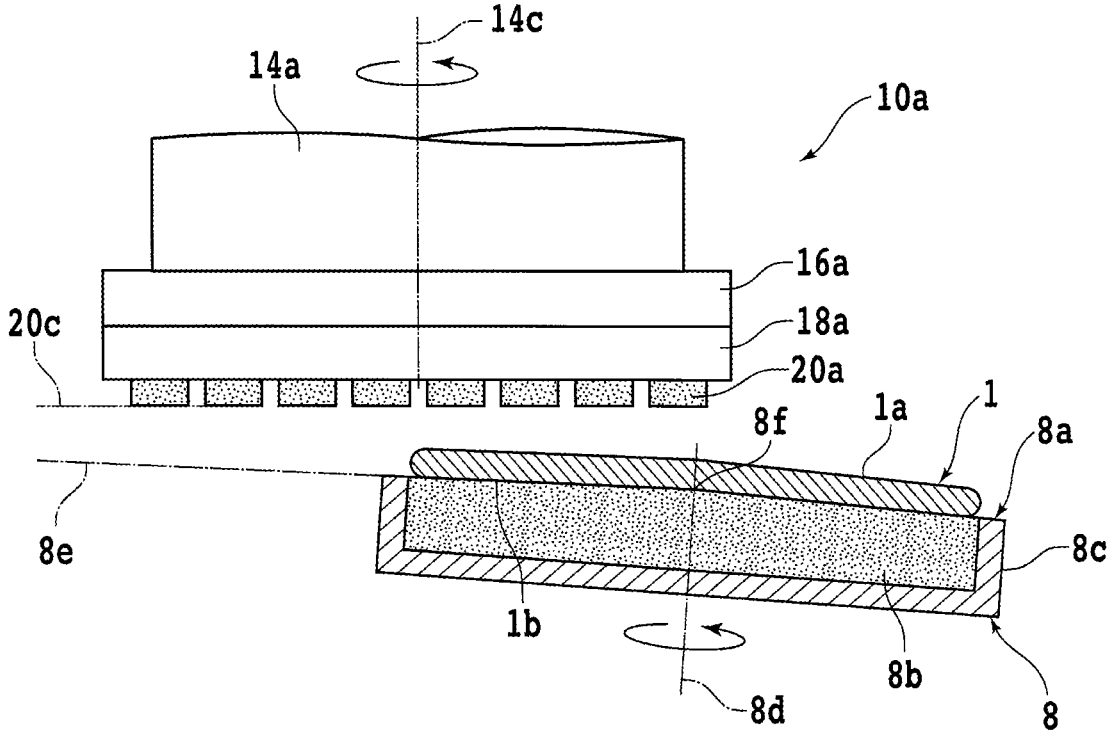
FIG. 2A is a sectional view schematically illustrating a first grinding step.

The holding table 8 internally has a suction path (not illustrated) having one end connected to a suction source (not illustrated), and the other end of the suction path is connected to a holding surface 8*a* on the holding table 8. As illustrated in FIG. 2A and so forth, the holding surface 8*a* is configured by a porous member 8*b*, and the porous member 8*b* is housed in a frame body 8*c* having a recessed part in an upper surface thereof. The holding table 8 sucks and holds the workpiece 1 by causing, through the porous member 8*b*, a negative pressure generated by the suction source to act on the workpiece 1 placed and put over the holding surface 8*a*. Further, a rotational drive source (not illustrated) such as a motor is connected to the bottom part of the holding table 8, and the holding table 8 can rotate around a table rotation axis 8*d* set to penetrate a center 8*f* of the holding surface 8*a*. Moreover, the bottom part of the holding table 8 is supported by plural support shafts that are not illustrated in the diagram, and one or a plurality of the support shafts can extend and contract. Further, the tilt of the holding surface 8*a* (tilt of the table rotation axis 8*d*) can be changed when the length of these support shafts is adjusted.

Referring back to FIG. 1, the description will be continued. Carrying-out and carrying-in of the workpiece 1 from and to the holding table 8 are executed in a wafer carrying-in/carrying-out region of the turntable 6. In the wafer carrying-in/carrying-out region, the workpiece 1 can be carried in to the holding table 8 by the loading arm 34, and the workpiece 1 can be carried out from the holding table 8 by the unloading arm 36. After the workpiece 1 is carried in, by the loading arm 34, to the holding table 8 positioned in the wafer carrying-in/carrying-out region, the turntable 6 is rotated, and the holding table 8 is moved to a next rough grinding region.

At the outside of the turntable 6 on the upper surface of the rear side of the base 4, a first grinding unit 10*a* that executes rough grinding of the grinding-target surface 1*a* of the workpiece 1 held by the holding table 8 positioned in the rough grinding region is disposed. After the rough grinding of the workpiece 1 is executed by the first grinding unit 10*a*, the turntable 6 is rotated, and the holding table 8 is moved to a finish grinding region adjacent to the rough grinding region. At the outside of the turntable 6 on the upper surface of the rear side of the base 4, a second grinding unit 10*b* that executes finish grinding of the grinding-target surface 1*a* of the workpiece 1 held by the holding table 8 positioned in the finish grinding region is disposed. After the finish grinding of the workpiece 1 is executed by the second grinding unit 10*b*, the turntable 6 is rotated to return the holding table 8 to the wafer carrying-in/carrying-out region, and the workpiece 1 is carried out from the holding table 8 by the unloading arm 36.

A spinner cleaning apparatus 38 that executes cleaning and spin drying of the ground workpiece 1 is disposed at the vicinity of the unloading arm 36 and the wafer conveying robot 30 on the upper surface of the base 4. Further, the workpiece 1 having cleaned and dried by the spinner cleaning apparatus 38 is conveyed from the spinner cleaning apparatus 38 by the wafer conveying robot 30 and is housed in the cassette 28*b* placed on the cassette placement pedestal 26*b*.

Columns 22*a* and 22*b* are disposed upright at the rear part of the base 4. A grinding feed unit 24*a* that supports the first grinding unit 10*a* movably along the vertical direction is disposed on the front surface of the column 22*a*. A grinding feed unit 24*b* that supports the second grinding unit 10*b* movably along the vertical direction is disposed on the front surface of the column 22*b*. The first grinding unit 10*a* supported by the grinding feed unit 24*a* includes a first spindle 14*a* that extends along the vertical direction and a spindle motor 12*a* connected to the upper end of the first spindle 14*a*. Further, the second grinding unit 10*b* supported by the grinding feed unit 24*b* includes a second spindle 14*b* that extends along the vertical direction and a spindle motor 12*b* connected to the upper end of the second spindle 14*b*. The orientations of the spindles 14*a* and 14*b* may be adjustable.

A wheel mount 16*a* with a circular plate shape is disposed at the lower end of the first spindle 14*a*, and a first grinding wheel 18*a* is fixed to the lower surface of the wheel mount 16*a*. Plural first grinding abrasive stones 20*a* arranged in a circular annular manner are mounted on the lower surface of the first grinding wheel 18*a*. A wheel mount 16*b* with a circular plate shape is disposed at the lower end of the second spindle 14*b*, and a second grinding wheel 18*b* is fixed to the lower surface of the wheel mount 16*b*. Plural second grinding abrasive stones 20*b* arranged in a circular annular manner are mounted on the lower surface of the second grinding wheel 18*b*.

When the spindle motor 12*a* is actuated to rotate the first spindle 14*a*, the first grinding wheel 18*a* rotates, and the first grinding abrasive stones 20*a* move on a first annular track. Then, when the grinding feed unit 24*a* is actuated to lower the first grinding unit 10*a* and the first grinding abrasive stones 20*a* are brought into contact with the grinding-target surface 1*a* of the workpiece 1 held by the holding table 8, the workpiece 1 is ground. Further, when the spindle motor 12*b* is actuated to rotate the second spindle 14*b*, the second grinding wheel 18*b* rotates, and the second grinding abrasive stones 20*b* move on a second annular track. Then, when the grinding feed unit 24*b* is actuated to lower the second grinding unit 10*b* and the second grinding abrasive stones

20*b* are brought into contact with the grinding-target surface 1*a* of the workpiece 1 held by the holding table 8, the workpiece 1 is ground.

In the grinding of the workpiece 1 with use of the first grinding unit 10*a*, the grinding feed by the grinding feed unit 24*a* is executed at a comparatively high speed, and the rough grinding of the workpiece 1 is executed. In the rough grinding by the first grinding unit 10*a*, a layer in which damage is caused and a minute recess-protrusion shape that are formed in the grinding-target surface 1*a* of the workpiece 1 are mainly removed. For example, when the workpiece 1 is an SiC wafer cut from an SiC ingot, the layer in which damage is caused and that is formed in the grinding-target surface 1*a* in association with the cutting is removed by the rough grinding. In the grinding of the workpiece 1 with use of the second grinding unit 10*b*, the grinding feed by the grinding feed unit 24*b* is executed at a comparatively low speed, and the finish grinding of the workpiece 1 is executed. In the finish grinding by the second grinding unit 10*b*, a layer in which damage is caused and that is formed in the grinding-target surface 1*a* due to the rough grinding is mainly removed. In the grinding-target surface 1*a* for which the finish grinding has been executed, the layer in which damage is caused and the minute recess-protrusion shape have been removed. Thus, devices can be favorably formed.

The first grinding abrasive stones 20*a* and the second grinding abrasive stones 20*b* contain abrasive grains formed of diamond or the like and a binder that fixes the abrasive grains in a dispersed manner. It is preferable that the second grinding abrasive stones 20*b* used for the finish grinding contain the abrasive grains with a smaller grain size than that of the abrasive grains contained in the first grinding abrasive stones 20*a* used for the rough grinding. In this case, the rough grinding of the workpiece 1 can be executed fast by the first grinding abrasive stones 20*a*, whereas the finish grinding of the workpiece 1 can be executed with high quality by the second grinding abrasive stones 20*b*.

A first thickness measuring unit 40 that measures the thickness of the workpiece 1 for which the rough grinding is executed by the first grinding unit 10*a* is disposed at the vicinity of the first grinding unit 10*a* on the upper surface of the base 4. A second thickness measuring unit 42 that measures the thickness of the workpiece 1 for which the finish grinding is executed by the second grinding unit 10*b* is disposed at the vicinity of the second grinding unit 10*b* on the upper surface of the base 4.

The first thickness measuring unit 40 and the second thickness measuring unit 42 are, for example, thickness measuring units of a contact type that get contact with the grinding-target surface 1*a* of the workpiece 1. The thickness measuring unit of a contact type includes two probes that extend to the upper side of the holding table 8, for example. Each probe includes a contact part that extends downward from the tip of an arm part extending in the horizontal direction. One probe measures the height of the grinding-target surface 1*a* of the workpiece 1 by bringing the lower end of the contact part into contact with the grinding-target surface 1*a* of the workpiece 1. Further, the other probe measures the height of the holding surface 8*a* by bringing the lower end of the contact part into contact with the holding surface 8*a* of the holding table 8. The workpiece 1 is placed and held over the holding surface 8*a* of the holding table 8 with the interposition of the protective member 3. Thus, the thickness measuring unit of a contact type can calculate the total thickness of the workpiece 1 and the protective member 3 from the difference between the measured height of the grinding-target surface 1*a* of the workpiece 1 and the height of the holding surface 8*a* of the holding table 8.

Alternatively, the first thickness measuring unit 40 and the second thickness measuring unit 42 are thickness measuring units of a contactless type that do not physically get contact with the grinding-target surface 1*a* of the workpiece 1. For example, the thickness measuring unit of a contactless type measures the height of the grinding-target surface 1*a* of the workpiece 1 by sending an ultrasonic wave or probe light to the grinding-target surface 1*a* from a measuring part disposed directly above the grinding-target surface 1*a* of the workpiece 1, by receiving reflected ultrasonic wave or the like by the measuring part, and by analyzing the ultrasonic wave or the like.

Here, as illustrated in FIG. 2A and so forth, the holding surface 8*a* of the holding table 8 is configured by a gentle conical surface having the center 8*f* as the apex. When the holding surface 8*a* is a conical surface, the workpiece 1 is slightly deformed in such a manner as to follow the holding surface 8*a* when the workpiece 1 is sucked and held by the holding table 8. Regarding the shapes of the workpiece 1, the holding table 8, and so forth illustrated in the diagrams, characteristics are exaggerated for convenience of explanation.

When the workpiece 1 is ground, the holding table 8 is rotated around the table rotation axis 8*d* in this state. Further, the grinding unit 10*a* or 10*b* is lowered while the spindle 14*a* or 14*b* is rotated, and the grinding abrasive stones 20*a* or 20*b* are brought into contact with the grinding-target surface 1*a* of the workpiece 1. The workpiece 1 placed over the holding table 8 thereby rotates while grinding processing progresses in a region with a circular arc shape from an outer circumferential part 1*d* of the workpiece 1 to a central part 1*c* thereof, so that the whole region of the workpiece 1 is ground.

Here, the lowering speed of the second grinding unit 10*b* in the finish grinding is comparatively low. Therefore, if a rise in the area of the contact of the second grinding abrasive stones 20*b* with the workpiece 1 is too sharp at the moment when the second grinding abrasive stones 20*b* get contact with the grinding-target surface 1*a* of the workpiece 1, it becomes difficult for the second grinding abrasive stones 20*b* to bite into the workpiece 1. Thus, the rough grinding is executed for the grinding-target surface 1*a* of the workpiece 1 by the first grinding unit 10*a* in such a manner that the grinding-target surface 1*a* becomes a conical surface that gently inclines from the central part 1*c* of the workpiece 1 to the outer circumferential part 1*d*, and the central part 1*c* of the workpiece 1 is set thick compared with the outer circumferential part 1*d*. This can be implemented by tilting the holding table 8 relative to the first grinding wheel 18*a* in such a manner that the generatrix closest to a rotation plane including the first annular track of the first grinding abrasive stones 20*a* in the generatrices that configure the holding surface 8*a* configured by the conical surface becomes non-parallel to the rotation plane. Thereafter, when the finish grinding is executed, the relative tilt between the holding table 8 and the second grinding wheel 18*b* is adjusted in such a manner that a rotation plane including the second annular track of the second grinding abrasive stones 20*b* becomes parallel to the generatrix of the holding surface 8*a* closest to the rotation plane. Then, the second grinding abrasive stones 20*b* that move on the second annular track are brought into contact with the workpiece 1 in which the central part 1*c* is thicker than the outer circumferential part 1*d*.

In this case, when the finish grinding is started, first, the second grinding abrasive stones 20*b* get contact with the relatively high central part 1*c* in the workpiece 1. At this time, the area of the contact of the second grinding abrasive stones 20*b* with the workpiece 1 is small. Therefore, the second grinding abrasive stones 20*b* easily bite into the workpiece 1. Then, the contact area gradually becomes larger as the finish grinding progresses and the height of the central part 1*c* becomes smaller, and finally the second grinding abrasive stones 20*b* get contact with the whole of the grinding-target surface 1*a* of the workpiece 1.

For example, when the workpiece 1 is an SiC wafer with a 4-inch diameter, it is preferable to execute the rough grinding by the first grinding unit 10*a* in such a manner that the height of the central part 1*c* of the workpiece 1 becomes higher than that of the outer circumferential part 1*d* by approximately 5 μm. Further, a layer in which damage is caused due to the rough grinding can be sufficiently removed by executing the finish grinding of the workpiece 1 to a depth of approximately 5 μm from the grinding-target surface 1*a*. Thus, it is preferable that, in the finish grinding, the workpiece 1 be ground in such a manner that the whole of the upper surface is exposed at a height position lower by approximately 5 μm than the height position of the grinding-target surface 1*a* of the workpiece 1 at the outer circumferential part 1*d* after the rough grinding.

When the finish grinding with use of the second grinding unit 10*b* is executed, conventionally, the height of the grinding-target surface 1*a* is monitored by using the second thickness measuring unit 42 in an intermediate region between the central part 1*c* and the outer circumferential part 1*d* of the grinding-target surface 1*a* of the workpiece 1. For example, in this example, the height position of the intermediate region of the grinding-target surface 1*a* is higher than the outer circumferential part 1*d* by approximately 2.5 μm at the timing of the end of the rough grinding. Thus, it is conceivable that the finish grinding is executed in such a manner that the grinding-target surface 1*a* becomes lower by approximately 7.5 μm in the intermediate region in order to remove the layer in which damage is caused in the whole region including the outer circumferential part 1*d*. However, when the rough grinding of the workpiece 1 that is hard, such as an SiC wafer, is executed, variation in the grinding result becomes large by reason that the grinding load greatly varies due to slight change in the state of the first grinding abrasive stones 20*a*, and so forth. For example, the height difference between the central part 1*c* and the outer circumferential part 1*d* of the workpiece 1 greatly varies. When this height difference becomes larger than expected and the grinding-target surface 1*a* inclines to a larger extent than expected, the outer circumferential part 1*d* of the workpiece 1 is not sufficiently ground when the workpiece 1 is removed with a predetermined thickness in the finish grinding, in some cases.

In the above-described example, in a case in which the height of the central part 1*c* becomes higher than that of the outer circumferential part 1*d* by approximately 10 μm in the rough grinding, the height of the intermediate region between the central part 1*c* and the outer circumferential part 1*d* of the grinding-target surface 1*a* becomes higher than that of the outer circumferential part 1*d* by 5 μm. In this case, it is impossible to remove the layer in which damage is caused in the whole of the grinding-target surface 1*a*, unless the finish grinding is executed in such a manner that the intermediate region becomes lower by approximately 10 μm. Thus, when the finish grinding is executed in such a manner that the intermediate region becomes lower by approximately 7.5 μm as initially expected, the outer circumferential part 1*d* of the workpiece 1 is not sufficiently ground, and the layer in which damage is caused due to the rough grinding is left in the workpiece 1. Thus, it is conceivable that the removal thickness of the workpiece 1 in the finish grinding is set large. However, in this case, the amount of grinding becomes large. When the amount of grinding becomes large, the processing time increases. Further, wear of the second grinding abrasive stones 20*b* becomes large, and frequent replacement work is required, for example. Thus, the large amount of grinding is a cause of lowering of the processing efficiency. Moreover, when the height difference between the central part 1*c* and the outer circumferential part 1*d* of the grinding-target surface 1*a* becomes smaller than expected when the rough grinding is executed, the workpiece 1 is excessively ground in the finish grinding.

Figure 5:
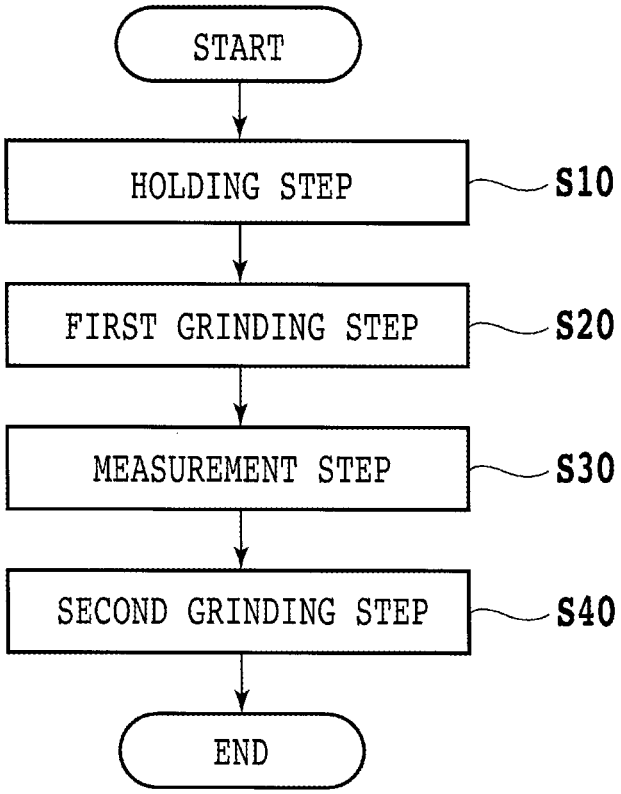
FIG. 5 is a flowchart illustrating the flow of the steps of a processing method of a workpiece.

Thus, in the grinding method of a workpiece according to the present embodiment to be described below, the thickness of the workpiece 1 at the outer circumferential part 1*d* is measured after the rough grinding by the first grinding unit 10*a* has ended, and the finished thickness of the workpiece 1 is decided based on the measurement value. Next, the grinding method of a workpiece according to the present embodiment will be described. FIG. 5 is a flowchart illustrating the flow of the steps of the grinding method of a workpiece according to the present embodiment. Each step of the grinding method of a workpiece according to the present embodiment will be described in detail below.

In the grinding method of a workpiece according to the present embodiment, first, a holding step S10 of placing the workpiece 1 over the holding surface 8*a* of the holding table 8 and holding the workpiece 1 by the holding table 8 is executed. The holding step S10 will be described in detail by using FIG. 1. In the holding step S10, first, the workpiece 1 is conveyed from the cassette 28*a* or 28*b* placed on the cassette placement pedestal 26*a* or 26*b* to the positioning table 32 by the wafer conveying robot 30, and the position of the workpiece 1 is adjusted. Then, the workpiece 1 is conveyed to, by the loading arm 34, over the holding surface 8*a* of the holding table 8 positioned in the wafer carrying-in/carrying-out region. At this time, the side of the grinding-target surface 1*a* of the workpiece 1 is exposed upward, and the side of the back surface 1*b* is made to face the holding surface 8*a*. Then, the workpiece 1 is sucked and held by the holding table 8. Thereafter, the turntable 6 is rotated in order to execute a first grinding step S20 to be described next, and the holding table 8 that holds the workpiece 1 is moved to the rough grinding region below the first grinding unit 10*a*.

Next, the first grinding step S20 is executed. FIG. 2A is a sectional view schematically illustrating the first grinding step S20. In FIG. 2A, a side view of part of the first grinding unit 10*a* and a sectional view of the holding table 8 that sucks and holds the workpiece 1 are included. In the first grinding step S20, the rough grinding of the workpiece 1 is executed by the first grinding unit 10*a*. In the first grinding step S20, first, the relative orientation of the first grinding unit 10*a* and the holding table 8 is adjusted. Specifically, the generatrix closest to the first grinding abrasive stones 20*a* in the holding surface 8*a* with the conical surface shape is set non-parallel to the first annular track. In FIG. 2A, an extension line 8*e* of this generatrix and a plane 20*c* including the first annular track are illustrated by one-dot chain lines for convenience of explanation.

In this state, the first spindle 14*a* is rotated around a spindle rotation axis 14*c* to rotate the first grinding abrasive stones 20*a* on the first annular track. In addition, the holding table 8 is rotated around the table rotation axis 8*d*. Then, the grinding feed unit 24*a* is actuated and the first grinding unit 10*a* is lowered, for example, to bring the holding table 8 and the first grinding wheel 18*a* close to each other. The bottom surfaces of the first grinding abrasive stones 20*a* thereby get contact with the grinding-target surface 1*a* of the workpiece 1, and the workpiece 1 is ground. The lowering speed of the first grinding unit 10*a* at this time is set higher than that of the second grinding unit 10*b* in a second grinding step S40 to be described later. When the first grinding step S20 is executed, the workpiece 1 is subjected to the rough grinding. At this time, the thickness of the workpiece 1 is monitored by using the first thickness measuring unit 40. Then, when the rough grinding of the workpiece 1 is executed until the thickness of the workpiece 1 becomes a predetermined thickness, the lowering of the first grinding unit 10*a* is stopped to end the rough grinding.

Figure 2B:
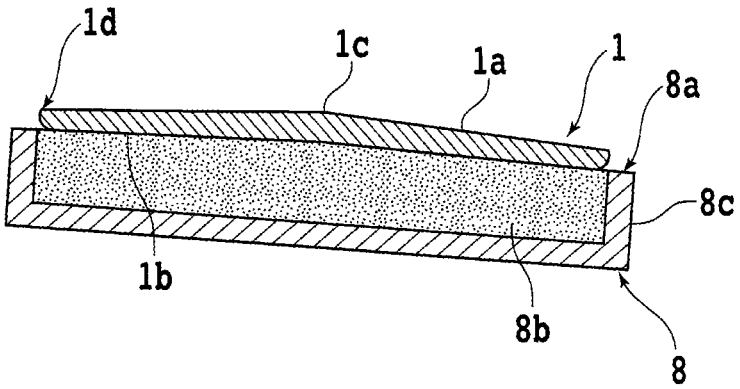
FIG. 2B is a sectional view schematically illustrating the workpiece at the time of the end of the first grinding step.

Here, when the workpiece 1 is an SiC wafer cut out from an ingot, the predetermined thickness is set to allow removal of a damage layer formed in the grinding-target surface 1*a* due to the cutting. FIG. 2B is a sectional view schematically illustrating the workpiece 1 for which the first grinding step S20 has ended and the rough grinding has been executed. As illustrated in FIG. 2B, when the first grinding step S20 is executed and the workpiece 1 is subjected to the rough grinding, the outer circumferential part 1*d* of the workpiece 1 becomes thinner than the central part 1*c*.

In the grinding-target surface 1*a* of the workpiece 1 for which the rough grinding has been executed, a minute recess-protrusion shape and damage such as a flaw referred to as crack, which are caused due to the rough grinding, are left. Thus, the finish grinding of the workpiece 1 is executed next to planarize the grinding-target surface 1*a* of the workpiece 1 while removing the layer in which damage is caused. Here, in the grinding method of a workpiece according to the present embodiment, after the first grinding step S20, a measurement step S30 is executed before the second grinding step S40 is executed. In the measurement step S30, the thickness of the workpiece 1 at the outer circumferential part 1*d* or the height of the upper surface (grinding-target surface 1*a*) of the workpiece 1 at the outer circumferential part 1*d* is measured. For example, this measurement is executed by the first thickness measuring unit 40 disposed near the first grinding unit 10*a* immediately after the end of the first grinding step S20. Alternatively, in the measurement step S30, the turntable 6 is rotated to send the holding table 8 to the finish grinding region below the second grinding unit 10*b*, and the measurement is executed by the second thickness measuring unit 42.

Figure 3:
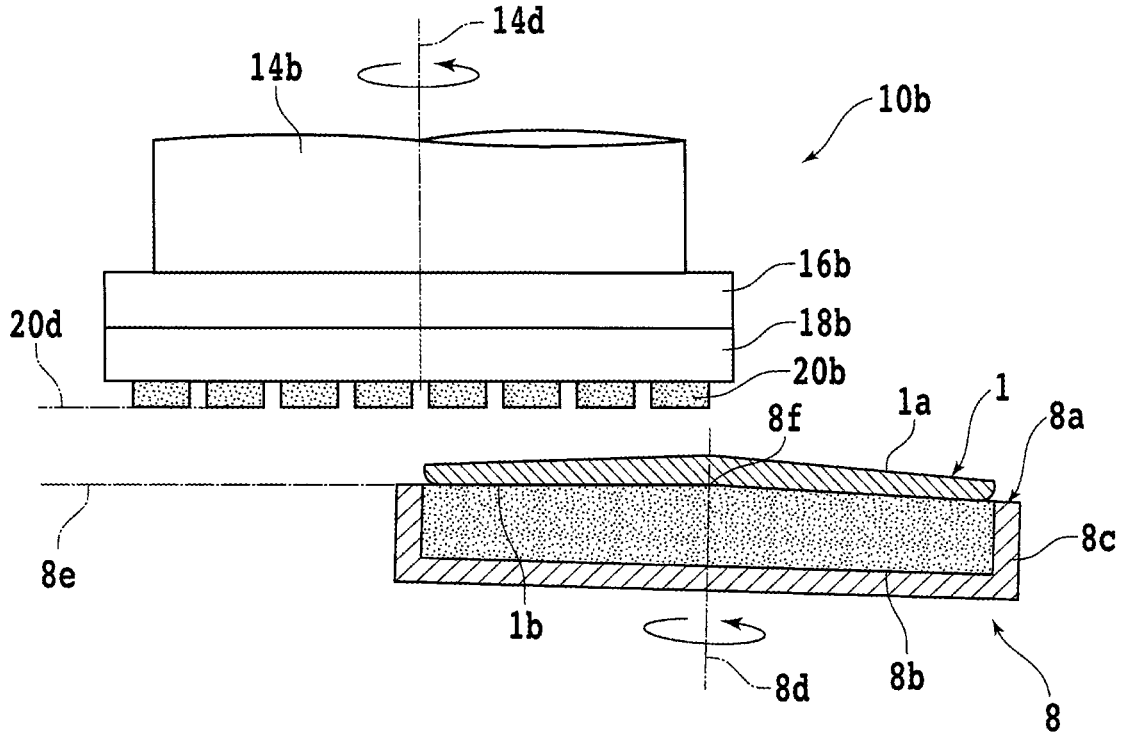
FIG. 3 is a sectional view schematically illustrating a second grinding step.

Next to the measurement step S30, the second grinding step S40 is executed. In a case in which the holding table 8 that sucks and holds the workpiece 1 has not been moved in the measurement step S30, first, the turntable 6 is rotated to send the holding table 8 to the finish grinding region in the second grinding step S40. FIG. 3 is a sectional view schematically illustrating the second grinding step S40. In FIG. 3, a side view schematically illustrating the second grinding unit 10*b* that grinds the workpiece 1 in the second grinding step S40 is included. Here, the relative orientation of the second grinding unit 10*b* and the holding table 8 is adjusted. Specifically, the generatrix closest to the second grinding abrasive stones 20*b* in the holding surface 8*a* with the conical surface shape is set parallel to the second annular track of the second grinding abrasive stones 20*b*. In FIG. 3, the extension line 8*e* of this generatrix and a plane 20*d* including the second annular track are illustrated by one-dot chain lines for convenience of explanation.

Figure 4A:
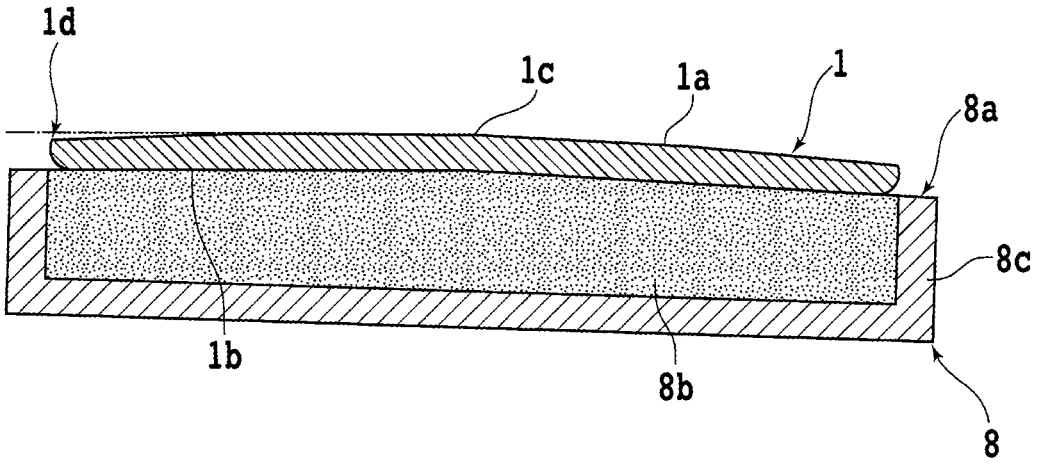
FIG. 4A is a sectional view schematically illustrating the workpiece in the middle of the second grinding step.

In this state, the second spindle 14*b* is rotated around a spindle rotation axis 14*d* to rotate the second grinding abrasive stones 20*b* on the second annular track. In addition, the holding table 8 is rotated around the table rotation axis 8*d*. Then, the grinding feed unit 24*b* is actuated and the second grinding unit 10*b* is lowered, or the like, to bring the holding table 8 and the second grinding wheel 18*b* close to each other. The bottom surfaces of the second grinding abrasive stones 20*b* thereby get contact with the grinding-target surface 1*a* of the workpiece 1, and the workpiece 1 is ground. Here, the second grinding abrasive stones 20*b* that move on the second annular track first get contact with the central part 1*c* which is the highest in the grinding-target surface 1*a* of the workpiece 1. FIG. 4A is a sectional view schematically illustrating the workpiece 1 in the middle of the second grinding step S40. Further, the area of the contact of the second grinding abrasive stones 20*b* with the grinding-target surface 1*a* gradually increases as the height of the workpiece 1 becomes lower at the central part 1*c*. Thus, the second grinding abrasive stones 20*b* properly bite into the grinding-target surface 1*a*, and the grinding-target surface 1*a* is properly ground.

In the second grinding step S40, the grinding is ended when the workpiece 1 reaches the finished thickness decided based on the thickness of the workpiece 1 at the outer circumferential part 1*d* or the height of the upper surface (grinding-target surface 1*a*) of the workpiece 1 at the outer circumferential part 1*d*, the thickness or the height being measured in the measurement step S30. For example, this finished thickness can be derived by subtracting a depth that allows sufficient removal of the layer in which damage is caused and that is formed in the grinding-target surface 1*a* of the workpiece 1 due to the rough grinding from the thickness of the workpiece 1 at the outer circumferential part 1*d* or the like measured in the measurement step S30. For example, when it is required to execute the finish grinding to a depth of 5 μm or larger in order to sufficiently remove the layer in which damage is caused, a height position lower by 5 μm than the height of the grinding-target surface 1*a* at the outer circumferential part 1*d* before the finish grinding is decided as the finished height position in the whole region of the workpiece 1. Further, the thickness of the workpiece 1 when the whole of the grinding-target surface 1*a* of the workpiece 1 reaches this finished height is deemed as the finished thickness of the workpiece 1.

Figure 4B:
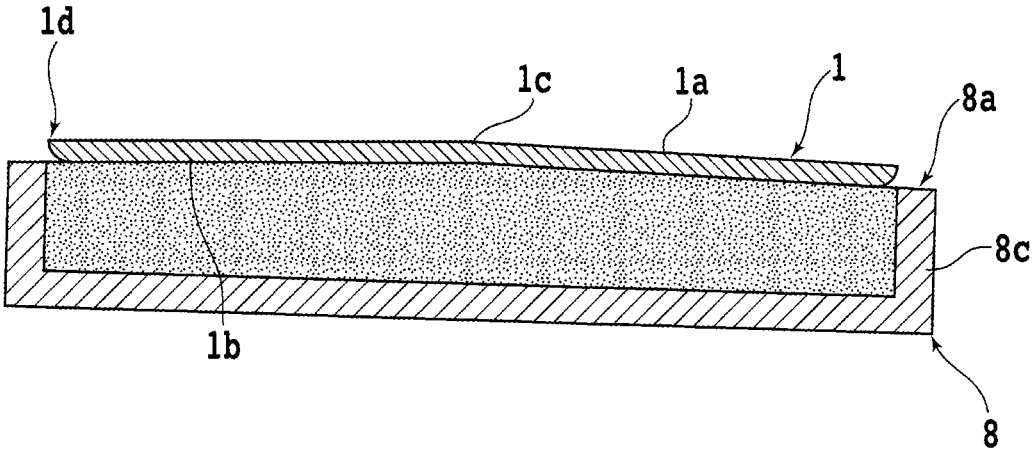
FIG. 4B is a sectional view schematically illustrating the workpiece sufficiently ground in the second grinding step.

In the second grinding step S40, for example, the finish grinding of the workpiece 1 is executed while the thickness of the workpiece 1 is monitored by the second thickness measuring unit 42, and the lowering of the second grinding unit 10*b* is stopped when the thickness of the workpiece 1 becomes this finished thickness. FIG. 4B is a sectional view schematically illustrating the workpiece 1 when the grinding by the second grinding unit 10*b* has been completed. In FIG. 4B, the second grinding unit 10*b* and so forth are omitted for convenience of explanation.

According to the grinding method of a workpiece according to the present embodiment, even at the outer circumferential part 1*d* of the workpiece 1, at which the layer in which damage is caused progresses to the deepest position in the rough grinding of the first grinding step S20, the finish grinding of the workpiece 1 can be executed to remove this layer in the second grinding step S40. Thus, the finish grinding is not ended in the state in which the finish grinding of the outer circumferential part 1*d* of the workpiece 1 has not been executed as illustrated in FIG. 4A. That is, even when large variation is caused in the height difference between the outer circumferential part 1*d* and the central part 1*c* of the workpiece 1 in the rough grinding, the finish grinding necessary for the workpiece 1 can surely be executed. On the other hand, even when the height difference between the outer circumferential part 1*d* and the central part 1*c* of the workpiece 1 becomes smaller than expected in the rough grinding, the finish grinding of the workpiece 1 is not excessively executed.

As described above, according to the grinding method of a workpiece according to the present embodiment, even when the workpiece 1 that is a grinding target is a hard member and variation in the processing result of the rough grinding becomes large, the workpiece 1 can be ground efficiently and surely. However, there is no limitation on the workpiece 1, and efficient and sure grinding can be executed even when the workpiece 1 is not hard.

The present invention is not limited to the description of the above embodiment and can be carried out with various changes. For example, in the above-described embodiment, description has been made about the case in which the grinding-target surface 1*a* inclines in such a manner that the outer circumferential part 1*d* of the workpiece 1 becomes lower than the central part 1*c* in the rough grinding executed in the first grinding step S20. However, the aspect of the present invention is not limited thereto.

It is also possible to execute the first grinding step S20 and execute the rough grinding of the workpiece 1 in such a manner that the central part 1*c* becomes thinner than the outer circumferential part 1*d* in order to allow the second grinding abrasive stones 20*b* to easily bite into the grinding-target surface 1*a* of the workpiece 1 when the second grinding step S40 is started. In this case, in the measurement step S30, the thickness of the workpiece 1 at the central part 1*c* or the height position of the upper surface (grinding-target surface 1*a*) of the workpiece 1 at the central part 1*c* is measured by the first thickness measuring unit 40 or the second thickness measuring unit 42. Then, in the second grinding step S40, the grinding is ended when the workpiece 1 reaches the finished thickness decided based on the thickness of the workpiece 1 at the central part 1*c* or the height position of the upper surface of the workpiece 1 at the central part 1*c*, the thickness or the height position being measured in the measurement step S30. As above, also when the central part 1*c* of the workpiece 1 becomes thin in the rough grinding, the workpiece can be ground highly efficiently and surely according to the grinding method of a workpiece according to the aspect of the present invention.

When variation in the processing result of the rough grinding executed in the first grinding step S20 is extremely large, it is also conceivable that at which of the central part 1*c* and the outer circumferential part 1*d* of the workpiece 1 the workpiece 1 becomes thin is not certain. In this case, it is preferable to measure the thickness or the like at both the central part 1*c* and the outer circumferential part 1*d* of the workpiece 1 in the measurement step S30. Further, it is preferable to end the grinding when the workpiece 1 reaches the finished thickness decided based on the thickness of the workpiece 1 measured at the thinner part of the central part 1*c* and the outer circumferential part 1*d* in the second grinding step S40.

The present invention is not limited to the details of the above described preferred embodiment. The scope of the invention is defined by the appended claims and all changes and modifications as fall within the equivalence of the scope of the claims are therefore to be embraced by the invention.

What is claimed is:

1. A grinding method of a workpiece that is a grinding method for grinding the workpiece, the grinding method comprising:

a holding step of placing the workpiece over a holding surface of a holding table that has the holding surface with a conical surface shape as an upper surface and that is rotatable around a table rotation axis that passes through a center of the holding surface and holding the workpiece by the holding table;

a first grinding step of grinding the workpiece in such a manner that an outer circumferential part of the workpiece becomes thinner than a central part of the workpiece by rotating a first spindle having a lower end to which a first grinding wheel having first grinding abrasive stones on a bottom surface is fixed to rotate the first grinding abrasive stones on a first annular track and by bringing the holding table and the first grinding wheel close to each other to cause the first grinding abrasive stones to get contact with the workpiece in a state in which a generatrix closest to the first grinding abrasive stones in the holding surface with the conical surface shape is set non-parallel to the first annular track;

a measurement step of measuring a thickness of the workpiece at the outer circumferential part or a height of an upper surface of the workpiece at the outer circumferential part after the first grinding step; and after the first grinding step, a second grinding step of grinding the workpiece by rotating a second spindle having a lower end to which a second grinding wheel having second grinding abrasive stones on a bottom surface is fixed to rotate the second grinding abrasive stones on a second annular track and by bringing the holding table and the second grinding wheel close to each other to cause the second grinding abrasive stones to get contact with the workpiece in a state in which a generatrix closest to the second grinding abrasive stones in the holding surface with the conical surface shape is set parallel to the second annular track, wherein the holding surface with the conical surface shape is set parallel to the second annular track prior to the initiation of grinding the workpiece with the second grinding abrasive stones, wherein, in the second grinding step, the grinding is started from the central part of the workpiece and the grinding is ended when the workpiece reaches a finished thickness of the workpiece at the outer circumferential part or the height of the upper surface of the workpiece at the outer circumferential part, wherein the finished thickness is set based on a result obtained during the measuring step at the end of the first grinding step and before the workpiece has been ground by the second grinding abrasive stones of the second grinding wheel.

2. The grinding method of a workpiece according to claim 1, wherein the second grinding abrasive stones contain abrasive grains with a grain size smaller than a grain size of abrasive grains contained in the first grinding abrasive stones.

3. The grinding method of claim 1 wherein the workpiece is a SiC wafer.

4. The grinding method of claim 3 wherein the SiC wafer has a 4-inch diameter and after the first grinding step and prior to the second grinding step a height of the central part of the wafer is 5 μm higher than that of the outer circumferential part of the wafer.

5. The grinding method of claim 3 wherein the second grinding step is ended after 5 μm has been ground from the outer circumferential part of the wafer during the second grinding step.

6. The grinding method of claim 3 wherein the SiC wafer has a 4-inch diameter and after the first grinding step and prior to the second grinding step a height of the central part of the wafer is 10 μm higher than that of the outer circumferential part of the wafer.

7. The grinding method of claim 1 wherein the measurement step is performed by a thickness measuring unit disposed adjacent the first grinding wheel.

8. The grinding method of claim 1 wherein the measurement step is performed by a thickness measuring unit disposed adjacent the second grinding wheel.

9. The grinding method of claim 1 wherein the second grinding step is ended after 5 μm has been ground from the outer circumferential part of the workpiece during the second grinding step.

10. The grinding method of claim 1 wherein the first grinding abrasive stones are removed from contact with the workpiece after the first grinding step and wherein the second grinding abrasive stones are brought into contact with the workpiece after the measuring step.

11. The grinding method of claim 1 wherein a thickness measuring unit disposed adjacent the second grinding wheel is used to determine when the workpiece reaches the finished thickness.

* * * * *